US006508634B2

(12) United States Patent
Ota et al.

(10) Patent No.: US 6,508,634 B2
(45) Date of Patent: Jan. 21, 2003

(54) COMPRESSOR UTILIZING SPACES BETWEEN CYLINDER BORES

(75) Inventors: Masaki Ota, Kariya (JP); Ken Suitou, Kariya (JP); Tomoji Tarutani, Kariya (JP); Kenta Nishimura, Kariya (JP); Taku Adaniya, Kariya (JP); Ryo Matsubara, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 7 days.

(21) Appl. No.: 09/905,142

(22) Filed: Jul. 13, 2001

(65) Prior Publication Data

US 2002/0006339 A1 Jan. 17, 2002

(30) Foreign Application Priority Data

Jul. 17, 2000 (JP) ..... 2000-215625

(51) Int. Cl.[7] ..... F04B 1/26
(52) U.S. Cl. ..... 417/222.2; 417/310
(58) Field of Search ..... 417/222.2, 310, 417/296; 92/71

(56) References Cited

U.S. PATENT DOCUMENTS 4,403,921 A * 9/1983 Kato et al. ..... 417/296
6,095,764 A * 8/2000 Shibamoto et al. ..... 417/310
6,227,812 B1 * 5/2001 Kawaguchi et al. ..... 417/222.2
6,241,483 B1 * 6/2001 Kato et al. ..... 417/222.2
6,334,759 B1 * 1/2002 Kaneko et al. ..... 417/222.2
6,354,810 B1 * 3/2002 Minami et al. ..... 417/222.2
6,425,741 B1 * 7/2002 Mera et al. ..... 417/222.2
2001/0029837 A1 * 10/2001 Kayukawa et al. ..... 92/71

* cited by examiner

*Primary Examiner*—Teresa Walberg
*Assistant Examiner*—Leonid M Fastovsky
(74) *Attorney, Agent, or Firm*—Woodcock Washburn LLP

(57) ABSTRACT

A compressor C has a construction comprising a cylinder block 1 in which cylinder bores 1*a* are formed, a front housing 2 and a rear housing 4 which are arranged at the front and at the rear, respectively, of the cylinder block 1. Pistons 20 which are accommodated in each cylinder bore 1*a* so as to be able to reciprocate, are connected to the cam plate 12, which connects to a drive shaft 6 so as to be able to integrally rotate, so as to operate, and the pistons 20 compress refrigerant gas according to the rotation of the drive shaft 6. A suction muffler 40, a discharge muffler 41 and a control valve 31 are provided between the cylinder bores 1*a* in the cylinder block 1. Further, a unit 60 which comprises a discharge check valve and an oil separator is disposed in the suction muffler 40.

9 Claims, 3 Drawing Sheets

COMPRESSOR UTILIZING SPACES BETWEEN CYLINDER BORES

BACKGROUND OF THE INVENTION

1. Field of the Invention

The present invention relates to a refrigerant compressor and, more particularly, to a refrigerant compressor of which the housing size can be reduced and the configuration of the housing can be designed more freely.

2. Description of the Related Art

A housing in a piston type compressor generally comprises a cylinder block, a front housing connected to the front thereof, and a rear housing connected to the rear thereof. A drive shaft which receives driving power from an external driving source, a cam plate connected to the drive shaft so as to be operated thereby, and pistons connected to the cam plate so as to be operated thereby are arranged in an area extending from the front housing to the cylinder block. In addition, cylinder bores, in which each piston is accommodated so as to be able to reciprocate, are arranged in the cylinder block. Also, a suction chamber into which refrigerant gas sucked into the cylinder bores is introduced and a discharge chamber into which refrigerant gas discharged from the cylinder bores is introduced are arranged in the rear housing.

Moreover, the compressors may further comprise mufflers which damp pulsations transmitted via refrigerant gas to an evaporator and a condenser from the inside of the compressor, check valves which prevent refrigerant gas from flowing reversely, an oil separator which separates a mist of lubrication oil, mixed with refrigerant gas, from the refrigerant gas, a displacement control valve which varies the discharge displacement of the refrigerant gas by changing the stroke of the pistons by pressure control, and so on, as additional components required to increase its function.

As the inside of the cylinder block is occupied by the cylinder bores when the additional components (mufflers, check valves, an oil separator and a displacement control valve) are arranged in the compressor, they are arranged in the front housing or the rear housing.

There is, however, a difficulty in design to provide a space for arranging the additional components because members, such as an arm which attaches the compressor to other members (for example, a vehicle side engine) are located in the front housing and the rear housing. A suction hole and a discharge hole which are communication passages with the outside of the compressor and most of the additional components are concentratedly arranged specially in the rear housing, because the suction chamber and the discharge chamber are closely located around the rear housing. These reasons make the rear housing and, as a result, the compressor, bulky.

SUMMARY OF THE INVENTION

The objective of the present invention is to provide a compressor in which the size of a housing thereof can be reduced and also the configuration of the housing can be designed more freely.

In order to solve the above problems, the first aspect of the present invention is a compressor; wherein a crank chamber is formed in a housing, also a drive shaft is supported so as to be able to rotate, cylinder bores are formed in a cylinder block, each piston is accommodated in each cylinder bore so as to be able to reciprocate therein, a cam plate is connected to the drive shaft so as to operate, the pistons are connected to the cam plate so as to operate, and the pistons reciprocate according to the rotation of the drive shaft so that refrigerant gas is sucked and discharged; the cylinder block, which is positioned between the front housing and the rear housing, comprises at least two of a suction space through which refrigerant gas sucked into the cylinder bores passes, a discharge space through which refrigerant gas discharged from the cylinder bores passes, a suction side check valve which is positioned upstream the suction space prevents refrigerant gas introduced into the suction space from reversely flowing upstream the suction space, a discharge side check valve which is positioned downstream the discharge space prevents refrigerant gas discharged from the discharged space to downstream side from reversely flowing into the discharge space, an oil separator which separates a mist of lubrication oil, mixed with refrigerant gas, from the refrigerant gas, and a control valve which varies the pressure in the crank chamber which accommodates the cam plate, between the cylinder bores in the cylinder block.

In this invention, by arranging at least two of the suction space, the discharge space, each check valve, the oil separator, and the control valve between the cylinder bores in the cylinder block, protruding volumes of each of the above-mentioned parts (the suction space, the discharge space, each check valve, the oil separator, and the control valve), outside the housing of the compressor, can be reduced. As the result, the size of the housing can be reduced and also the configuration of the housing (specially for front housing and rear housing) can be designed more freely.

The second aspect of the present invention is that, in the first aspect of the present invention, "N" (N is an integral number which is not less than 2) sets of cylinder bores are provided in the cylinder block, and not less than N of the suction space, the discharge space, the suction side check valve, the discharge side check valve, the oil separator, and the control valve are provided between the cylinder bores in the cylinder block.

In this invention, by comprising N sets of cylinder bores in the cylinder block, regions between the same cylinder bores are formed in number "IN". By effectively utilizing the N sets of regions, those, not less than N, of the suction space, the discharge space, the suction side check valve, the discharge side check valve, the oil separator, and the control valve are disposed in the regions so that the size of the housing can be more preferably reduced and also the configuration of the housing can be designed more freely.

The third aspect of the present invention is that, in the second aspect of the present invention, at least one of the suction space, the discharge space, the suction side check valve, the discharge side check valve, the oil separator, and the control valve are provided between each cylinder bore in the cylinder block.

In this invention, all of the regions between the cylinder bores are utilized for disposing at least one of the suction space, the discharge space, the suction side check valve, the discharge side check valve, the oil separator, and the control valve therein. That is to say, all of the regions between the cylinder bores are utilized for such disposition. This allows that the size of the housing can be more preferably reduced and also the configuration of the housing can be designed more freely.

The fourth aspect of the present invention is that, in any one of the first aspect to third aspect of the present invention, at least one of the suction space or the discharge space are provided between the cylinder bores in the cylinder block.

In this invention, the suction space and the discharge space, which require relatively large space, are disposed in the cylinder block, so that the size of the compressor can be effectively reduced and also the configuration of the housing can be designed more freely.

The fifth aspect of the present invention is that, in any one of the second aspect to fourth aspect of the present invention, the discharge space is provided between the cylinder bores in the cylinder block and at least one of the discharge side check valve or the oil separator are disposed in the discharge space.

In this invention, the discharge space is utilized to dispose at least one of the discharge side check valve or the oil separator therein so that the regions between the cylinder bores are utilized more effectively. Thus the size of the housing can be more preferably reduced and also the configuration of the housing can be designed more freely.

The sixth aspect of the present invention is that, in any one of the first aspect to fifth aspect of the present invention, the pressure difference, through the piston, between the pressure in the crank chamber and the pressure in the cylinder bores is varied by the control valve, and then the inclination angle of the cam plate is changed according to the pressure difference, so that the compressor is a variable displacement type which controls the discharge displacement thereof.

In this invention, the compressor is constructed as a variable displacement type and a control valve having a relatively large volume is added to the optional components which are disposed between cylinder bores in the cylinder block so that the size of the housing of the compressor of variable displacement type can be more effectively reduced and also the configuration of the housing can be designed more freely.

The seventh aspect of the present invention is that, in the sixth aspect of the present invention, cylinder bores, which number not less than three, are provided in the cylinder block and the suction space, the discharge space and the control valve are provided between the cylinder bores in the cylinder block.

In this invention, the suction space, the discharge space and the control valve which require a relatively large space are disposed between the cylinder bores 1*a* in the cylinder block, so that the size of the compressor can be effectively reduced and also the configuration of the housing can be designed more freely.

The present invention may be more fully understood from the description of the preferred embodiments of the invention set forth below, together with the accompanying drawings.

DESCRIPTION OF THE PREFERRED EMBODIMENTS

An embodiment of the present invention is described below with reference to FIG. 1 and FIG. 2.

Figure 1:
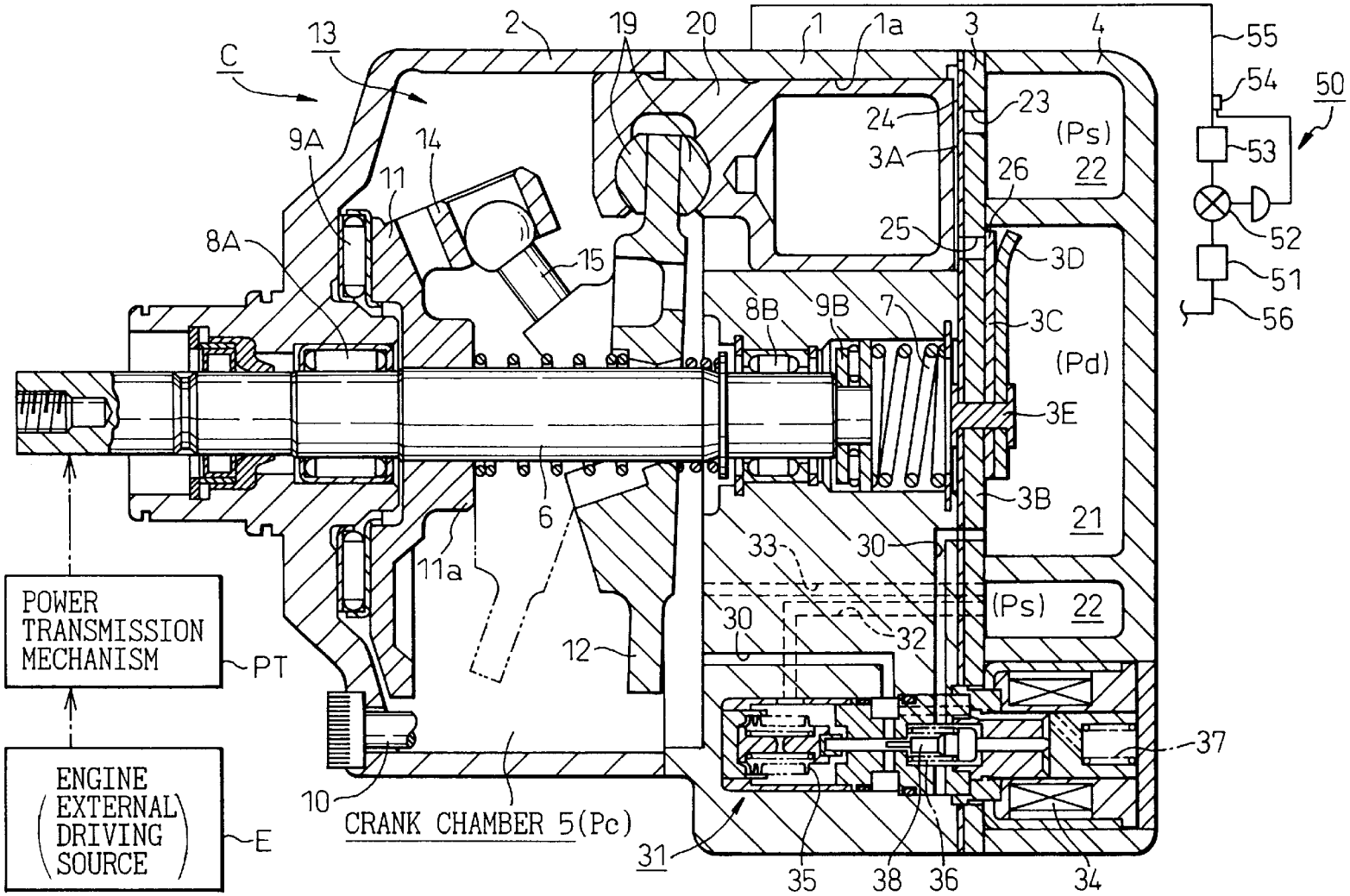
FIG. 1 is a cross-sectional view that illustrates the outline of one embodiment of a compressor.

As shown in FIG. 1, a compressor C comprises a cylinder block 1, a front housing 2 coupled to the front end of the cylinder block 1, and a rear housing 4 coupled to the rear end of the cylinder block 1 via a valve forming body 3. Thus the cylinder block 1, the front housing 2, the valve forming body 3, and the rear housing 4, are coupled and fixed to each other by plural (6 pieces in this embodiment) through-bolts 10 (only one is shown in FIG. 1), and constitute a housing of the compressor C. In the region surrounded by the cylinder block 1 and the front housing 2, a crank chamber 5 is defined. In the crank chamber 5, a drive shaft 6 is supported by a pair of radial bearings 8A and 8B, one in front and one in rear, so that a reciprocating motion is enabled. A spring 7 and a rear thrust bearing 9B are disposed in a housing recess formed in the center of the cylinder block 1. On the other hand, a lug plate 11 is fixed on the drive shaft 6 in the crank chamber 5 so that a reciprocating motion is integrally enabled and a front thrust bearing 9A is disposed between the lug plate 11 and the internal wall surface of the front housing 2. The drive shaft 6 and the lug plate 11 both integrally coupled are positioned in a thrust direction (in the axial direction of the drive shaft 6) by a front thrust bearing 9A and a rear thrust bearing 9B which are biased forward by a spring 7.

The front end of the drive shaft 6 is connected to a vehicle engine E, which functions as an external driving source, via a power transmission mechanism PT. The power transmission mechanism PT may be a clutch mechanism (for example, an electromagnetic clutch) which can select the transmission and the isolation of power by an external electric control or may be a clutch-less mechanism of a permanent connection type (for example, a combination of a belt and a pulley) which does not comprise such a clutch mechanism. In this embodiment a power transmission mechanism of a clutch-less type is employed.

As shown in FIG. 1, a swash plate 12 as a cam plate is housed in a crank chamber 5. A through hole is penetrated through the center portion of the swash plate 12 and the drive shaft 6 is positioned in the through hole. The swash plate 12 is coupled to the lug plate 11 and the drive shaft 6 via the hinge mechanism 13, as a coupling guide mechanism, so as to be operated. The hinge mechanism 13 comprises two supporting arms 14 (only one is shown) protruding from the rear surface of the lug plate 11 and two guide pins 15 (only one is shown) protruding from the front surface of the swash plate 12. The swash plate 12 can synchronously rotate with the lug plate 11 and the drive shaft 6 by cooperation with the support arms 14 and the guide pins 15 and by contact with drive shaft 6 in the center through hole of the swash plate 12 and can also tilt, with respect to the drive shaft 6, accompanied by the sliding movement in an axial direction of the drive shaft 6. In addition, in this case the inclination angle (inclination) of the swash plate 12 is defined as the angle formed between the virtual plane perpendicular to the drive shaft 6 and the swash plate 12.

Plural (three in this embodiment) cylinder bores 1*a* (only one is shown in FIG. 1) are formed, in a cylinder block 1, surrounding the drive shaft 6 and the rear end of each cylinder bore 1*a* is closed by the valve forming body 3. A single-headed piston 20 is housed in each cylinder bore 1*a* so that a reciprocating motion is enabled and a compression chamber which varies its volume according to the reciprocating motion of the piston 20 is defined in the each cylinder bore 1*a*. The front end of the each piston 20 is connected to the outer circumferential portion of the swash plate 12 via a pair of shoes 19 and each piston 20 is coupled to the swash plate 12 via the shoes 19 so as to be operated. This enables the rotating motion of the swash plate 12 to be converted to a reciprocating linear motion of the pistons 20 with a stroke corresponding to the inclination angle thereof when the swash plate 12 synchronously rotates with the drive shaft 6.

Further, between the valve forming body 3 and the rear housing 4, a discharge chamber 21 which constitutes a discharge space locating at the center area and a suction chamber 22 which constitutes a suction space surrounding the discharge chamber 21 are defined. The valve forming body 3 consists of a suction valve forming plate 3A, a port forming plate 3B, a discharge valve forming plate 3C and a retainer forming plate 3D in a stacked manner thereof. The respective forming plates are stacked and secured by a pin 3E. A suction port 23 and a suction valve 24 which opens and closes the same port 23, and a discharge port 25 and a discharge valve 26 which opens and closes the same port 25 are formed in the valve forming body 3 in a manner they are located corresponding to each cylinder bore 1*a*. The suction chamber 22 communicates with each cylinder bore 1*a* via the suction port 23 and each cylinder bore 1*a* communicates with the discharge chamber 21 via the discharge port 25.

The discharge chamber 21 connects to the crank chamber 5 through a supply passage 30. A control valve 31 is provided on the way in the supply passage 30. In addition, a pressure detecting passage 32 which introduces a suction pressure Ps into the control valve 31 is formed between the suction chamber 22 and the control valve 31. Further, the suction chamber 22 connects to the crank chamber 5 through a bleed passage 33.

The control valve 31 has the same construction as that of the displacement control valve shown in FIG. 1 in the publication of Japanese unexamined patent application (Kokai) no. 10-141221. That is, the position of the valve portion 38 is designed to be varied, according to the balance of biasing forces created by a solenoid portion 34, a bellows 35, a forcedly opening spring 36 and an auxiliary spring 37, so that the opening of the supply passage 30 is regulated. The solenoid portion 34 is actuated by a current output by an electric drive circuit, not shown, based on the signal from a control computer, not shown. The bellows 35 expands and retracts based on the value of a suction pressure Ps transmitted from the suction chamber 22 through the pressure detecting passage 32.

The balance between the flow rate of high pressure gas to the crank chamber 5 through the supply passage 30 and the flow rate of gas from the crank chamber 5 through the bleed passage 33 is controlled by adjusting the opening of the control valve 31 and then the crank pressure Pc is determined thereby. The pressure difference between the crank pressure Pc and the internal pressure in the cylinder bore 1*a*, via the piston 20, is varied according to the change of the crank pressure Pc and the inclination angle of the swash plate 12 is changed, to regulate the stroke of the piston 20, that is, the discharge displacement.

Figure 2:
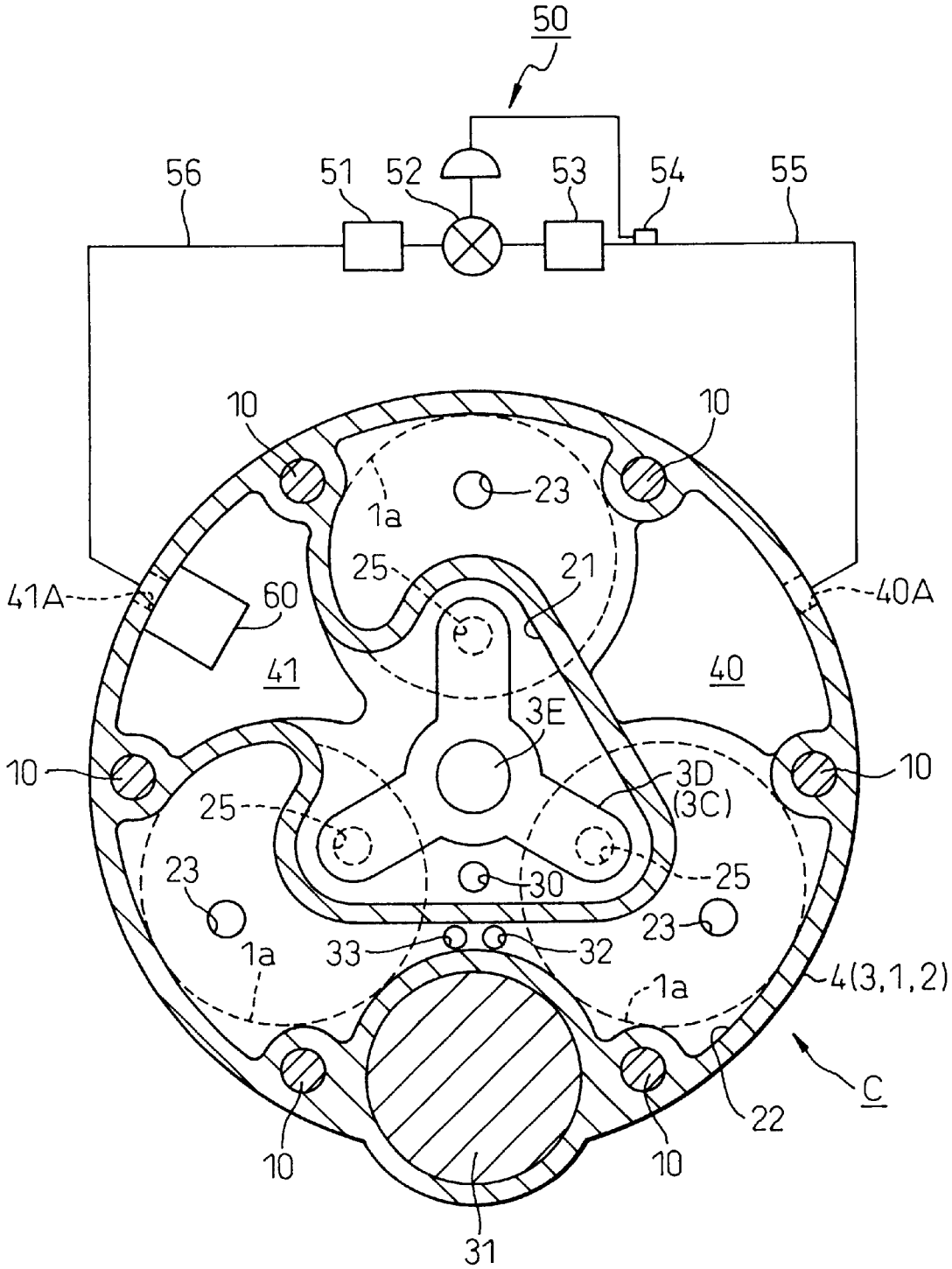
FIG. 2 is a sectional view that illustrates the arrangement of each muffler of the compressor.

As shown in FIG. 1 and FIG. 2, the control valve 31 is arranged in a portion of areas between each cylinder bore 1*a*, along through from the cylinder block 1 to the rear housing 4, so that the longitudinal direction of the control valve 31 is in parallel to the axial direction of the drive shaft 6. As shown in FIG. 2, a suction muffler 40 which constitutes a suction space and a discharge muffler 41 which constitutes a discharge space are also formed, respectively, in the residual two portions of areas between each cylinder bore 1*a* in cylinder block 1. Each muffler 40 and 41 is formed with a cross section of an approximately triangle shape so as to come near each cylinder bore 1*a* so that they lie through inside the cylinder block 1 from front to rear and the spaces between each cylinder bore 1*a* can be utilized effectively as far as possible. For illustration, however, in FIG. 1, the cylinder bores 1*a* are shown to have a smaller diameter than that of FIG. 2.

The rear side (the rear housing 4 side) of the suction muffler 40 communicates with the suction chamber 22 and a suction hole 40A which communicates an external refrigerant circuit 50, described below, with the suction muffler 40 is provided in the front side (the front housing 2 side) of the suction muffler 40.

The rear side of the discharge muffler 41 communicates through the discharge chamber 21 and a discharge hole 41A which communicates the external refrigerant circuit 50, described below, with the discharge muffler 41 is provided in the front side of the discharge muffler 41.

The suction hole 40A connects to the discharge hole 41A through the external refrigerant circuit 50. The external refrigerant circuit 50, for example, comprises a condenser 51, a temperature type expansion valve 52 and an evaporator 53. The opening of the temperature type expansion valve 52 is feedback-controlled based on the temperature detected by a thermo-sensing coupler 54 provided at an outlet side or a downstream side of the evaporator 53 and based on the evaporating pressure (the outlet pressure of the evaporator). The temperature type expansion valve 52 supplies refrigerant liquid to the evaporator 53 corresponding to heat load and regulates the flow rate of refrigerant in the external refrigerant circuit 50. A communication tube 55 for refrigerant gas which connects the outlet of the evaporator 53 to the suction hole 40A of the compressor C is provided in a downstream region of the external refrigerant circuit 50. A communication tube 56 for refrigerant which connects the discharge hole 41A of the compressor C to the inlet of the condenser 51 is provided in an upstream region of the external refrigerant circuit 50.

As shown in FIG. 2, a unit 60 is attached on the discharge muffler 41. The unit 60 is coupled to, and fixed on, the inner circumferential wall surface of the cylinder block 1 so as to cover the discharge hole 41A.

Figure 3:
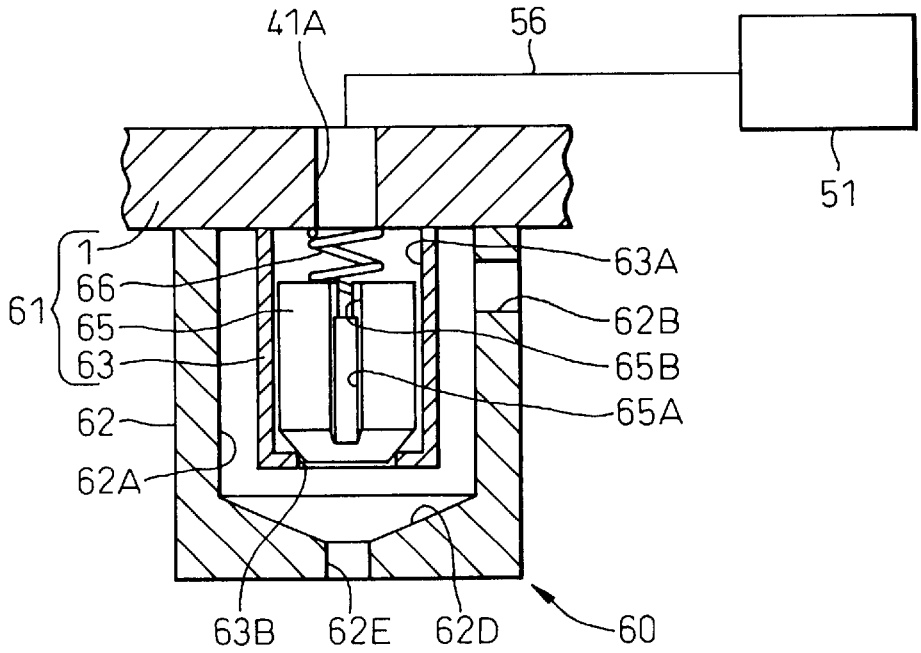
FIG. 3 is a cross-sectional view that illustrates the outline of a check valve and an oil separator of the compressor.

As shown in FIG. 3, the unit 60 comprises an approximately cylindrical case 62 with a bottom and a check valve 61 housed in the case 62. The check valve 61 comprises an approximately cylindrical casing 63, with a bottom, of which an end surface at an opening side is coupled to, and fixed on, the circumferential wall surface of the cylinder block 1. A valve chamber 63A is formed in the casing 63 with the end surface at opening side of the casing 63 covered by the circumferential wall surface of the cylinder block 1. A valve inlet 63B, as an inlet for refrigerant, is provided in a bottom of the casing 63. In addition, on the contrary, the discharge hole 41A is provided to function as an outlet for the refrigerant. A valve portion 65 is housed in the valve chamber 63A so as to be able to reciprocate between the valve inlet 63B and the discharge hole 41A. The valve portion 65 is constructed to be biased against the valve inlet 63B side by a valve closing spring 66.

Figure 4:
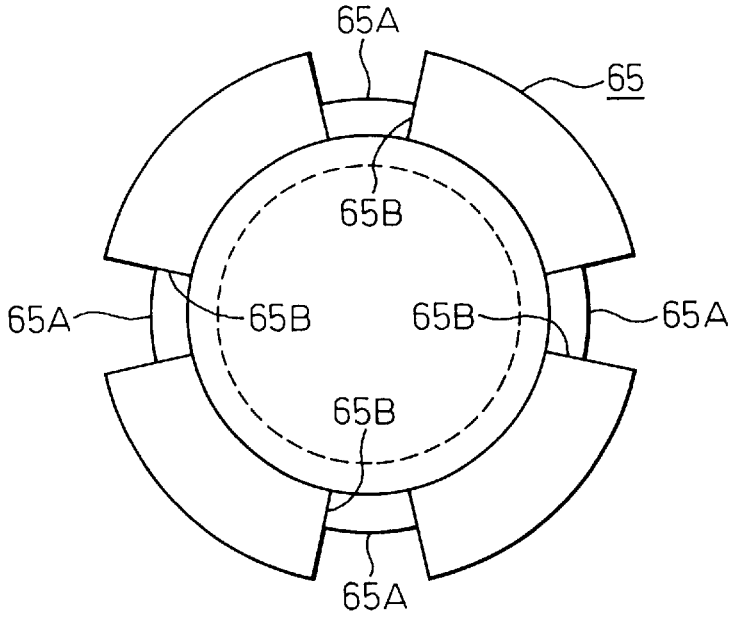
FIG. 4 is an enlarged plan view in viewing the valve portion from an upper direction.

The valve portion 65 has an approximately cylindrical shape with a bottom and a portion of a bottom side thereof is formed in a tapered shape with gradually smaller diameter in the direction toward top thereof. When the valve portion 65 is biased against the valve inlet 63B side, a part of this tapered portion enters into the valve inlet 63B to close the valve inlet 63B. The outer circumferential surface of the valve portion 65 has plural (four in this embodiment) grooves 65A directing in the axial direction of the valve portion 65 (refer to FIG. 4 which is a view wherein the valve portion 65 is viewed from the opening side thereof). A cutout 65B is formed on the end surface of the valve portion 65 at the opening side in the groove 65A and the outer side of the valve portion 65 communicates with the inner side thereof. When the valve portion 65 is moved to the circumferential wall surface side of the cylinder block 1 against the biasing force of the valve closing spring 66, the opening side of the valve portion 65 comes into contact with the circumferential wall surface so as to restrict further movement. Then, though the discharge hole 41A is designed to be covered by the opening side of the valve portion 65, the valve inlet 63B communicates with the discharge hole 41A via the grooves 65A and the cutout 65B.

The opening and the closing of the valve inlet 63B is operated by the balance between biasing force of refrigerant pressure at an upstream side of the check valve 61 against the valve portion 65, the biasing force of refrigerant pressure at a downstream side of the check valve 61 against the valve portion 65, and the biasing force of the valve closing spring 66, so that the refrigerant is prevented from flowing reversely. When the biasing force of the upstream side pressure exceeds the total force of the biasing force of the downstream side pressure and the biasing force of the valve closing spring 66, the check valve 61 permits the refrigerant to flow. On the contrary, when the biasing force of the upstream side pressure becomes smaller than the total force of the biasing force of the downstream side pressure and the biasing force of the valve closing spring 66, the check valve 61 does not permit the refrigerant to flow. That is, the check valve 61 can prevent the refrigerant from flowing reversely from the downstream side (the external refrigerant circuit 50 side) to the upstream side (the discharge chamber 21 side). In this case, the check valve 61 functions as a discharge side check valve which prevents the refrigerant, discharged from the discharge muffler 41 to the downstream outside of the discharge muffler 41, from flowing reversely to the discharge muffler 41.

In the state in which the check valve 61 is housed in the case 62, the opening side of the case 62 is covered by the circumferential wall surface of the cylinder block 1, so that a separating chamber 62A is defined. An introducing port 62B which introduces refrigerant in the discharge muffler 41 into the separating chamber 62A is provided in the case 62. The introducing port 62B is provided along the circumferential direction of the case 62 so that refrigerant introduced into the separating chamber 62A rotates in the separating chamber 62A. As a casing 63 of the check valve 61 is located in the separating chamber 62A, actually the refrigerant introduced from the introducing port 62B to the separating chamber 62A rotates in a clearance between the inner circumferential surface of the case 62 and the outer circumferential surface of the casing 63. This rotating motion centrifugally separates lubrication oil, mixed with the refrigerant, so that the lubrication oil adheres to the inner circumferential surface of the case 62.

Further, a tapered inclined recess 62D is provided on the bottom of the case 62 so that the lubrication oil which adheres on the inner circumferential surface of the case 62 and drops down is collected in the deepest portion of the inclined recess 62D. A drain passage 62E which discharges the lubrication oil out of the unit 60 is provided in the deepest portion of the inclined recess 62D. The lubrication oil drained out of the unit 60 through the drain passage 62E is introduced into the upstream side of the control valve 31 in the supply passage 30 through an oil supply passage, not shown, so as to be supplied to the crank chamber 5. However, an oil separator which separates the mist of lubrication oil, mixed with refrigerant, is constituted by the case 62, the casing 63 and the circumferential wall surface of the cylinder block 1.

Next, the functions of the compressor constituted as described above are described. Driving power is supplied from an vehicle engine E to the drive shaft 6 via a power transmission mechanism PT and then the swash plate 12 rotates together with the driving shaft 6. Each piston 20 reciprocates according to the rotation of the swash plate 12 in a stroke corresponding to the inclination angle of the swash plate 12 and the suction, the compression and the discharge of refrigerant is repeated, in turn, in each cylinder bore 1*a*.

When the cooling load is high, the control computer sends a command signal to the electric driving circuit so that the value of the current supplied to the solenoid portion 34 increases. The variation of the current value from the electric driving circuit based on the signal allows the solenoid portion 34 to increase the biasing force so that the valve portion 38 further decreases the opening of the supply passage 30. As the result, the bellows 35 decreases the opening of the supply passage 30 by actuating the valve portion 38. Thus the flow rate of high pressure refrigerant gas supplied from the discharge chamber 21 to the crank chamber 5 via the supply passage 30 decreases, the pressure of the crank chamber 5 is lowered, the inclination angle of the swash plate 12 increases, and the discharge displacement of the compressor C increases. When the opening of the supply passage 30 is fully closed, the pressure of the crank chamber 5 decreases in large amount, the inclination angle of the swash plate 12 increases to the maximum, and the discharge displacement of the compressor C increases to the maximum.

On the contrary, when the cooling load is low, the solenoid portion 34 decreases the biasing force so that the valve portion 38 further increases the opening of the supply passage 30. As the result, the bellows 35 increases the opening of the supply passage 30 by actuating the valve portion 38. Thus the pressure of the crank chamber 5 is raised, the inclination angle of the swash plate 12 decreases and the discharge displacement of the compressor C decreases. When the opening of the supply passage 30 is fully open, the pressure of the crank chamber 5 is raised in large amount, the inclination angle of the swash plate 12 decreases to the minimum and the discharge displacement of the compressor C decreases to the minimum.

The refrigerant, discharged to the discharge chamber 21 after being compressed in the cylinder bores 1*a,* is introduced into the discharge muffler 41 and reaches the external refrigerant circuit 50 via the unit 60 and the discharge hole 41A. Then the pulsation of the refrigerant, created when the refrigerant is discharged from the cylinder bores 1*a,* is damped while it is transmitted to the discharge hole 41A side via the discharge chamber 21 and the discharge muffler 41. Thus the pulsation transmitted to the condenser 51 is lowered. Then the refrigerant, which reaches the suction hole 40A from the external refrigerant circuit 50, is introduced into the suction chamber 22 after passing through the suction muffler 40, and is sucked into the cylinder bores 1*a* so as to be compressed. The pulsation of the refrigerant, created when the refrigerant is sucked into the cylinder bores 1*a,* is damped while it is transmitted to the suction hole 40A side via the suction chamber 22 and the suction muffler 40. Thus the pulsation transmitted to the evaporator 53 is lowered.

The refrigerant (a mist of lubrication oil is mixed in this refrigerant) introduced into the separating chamber 62A via the introducing port 62B of the unit 60 rotates in the clearance between the inner circumferential surface of the case 62 and the outer circumferential surface of the casing 63 of the check valve 61. After the lubrication oil is centrifugally separated during rotation thereof and is collected into the inclined recess 62D, it is introduced into the crank chamber 5 via the drain passage 62E, the oil supply passage, the supply passage 30 and the control valve 31. The lubrication oil introduced into the crank chamber 5 lubricates components of the mechanism (such as bearings, a hinge mechanism, etc.) in the crank chamber 5.

The refrigerant separated from the lubrication oil is prone to flow into the valve chamber 63A via the valve inlet 63B. Then the refrigerant pushes the valve portion 65 up, passes through the clearance, formed between the bottom portion of the valve portion 65 and the valve inlet 63B, so as to flow into the valve chamber 63A, passes through the grooves 65A and reaches the valve hole 41A. When the valve portion 65 comes into contact with the circumferential wall surface of the cylinder block 1 by being pushed up by the refrigerant, the refrigerant, after passing through the grooves 65A, reaches the discharge hole 41A through the clearance formed by the circumferential wall surface and the cutout 65B. The refrigerant which reaches the outside of the valve chamber 63A through the discharge hole 41A flows into the external refrigerant circuit 50 through the communication tube 66 and provides the heat exchanging effect.

This embodiment can provide the following effect.

(1)

Because the suction muffler 40 and the discharge muffler 41 are arranged between the cylinder bores 1*a* in the cylinder block 1, it is not required that both mufflers 40 and 41 are arranged to protrude outside (specially in the radial direction of the drive shaft 6) the housing of the compressor C or are provided in other configuration separated from the housing thereof. That is, the size of the compressor C can be reduced. As both mufflers 40 and 41 have such structures that require a relatively large volume, the effect due to the prevention of a size increase thereof is remarkable. It can provide a cost reduction compared to the case in which both mufflers 40 and 41 are formed in other configurations separated from the housing of the compressor C.

(2)

Because the control valve 31 is arranged between the cylinder bores 1*a* in the cylinder block 1, the protrusion of the control valve 31 to the rear housing 4 side can be reduced. That is, the volume of the rear housing 4 can be reduced, which contributes to a reduction in the size of the compressor C.

(3)

The control valve 31 is arranged between the cylinder bores 1*a* in the cylinder block 1 and the protrusion of the control valve 31 to the rear housing 4 side can be reduced, so that the configuration of the rear housing 4 can be designed more freely. Therefore, the configuration of the rear housing 4 can have higher priority in fabrication process thereof and a cost reduction is possible. In addition, such members as an arm, etc. which is used to attach the compressor C to other members (for example, the vehicle engine E at a vehicle side, etc.) are easy to install on the rear housing 4.

(4)

The utilization of the spaces between the cylinder bores 1*a* in the cylinder block 1 for arranging the control valve 31 permits the size of the control valve 31 to be increased without increasing the size of the compressor C.

(5)

The control valve 31 is arranged between the cylinder bores 1*a* in the cylinder block 1, so that the control valve 31 can be located near the crank chamber 5. That is, the supply passage 30 can be shortened and the response of the control of the discharge displacement can be improved.

(6)

By utilizing the spaces between all cylinder bores 1*a* in the cylinder block 1, the suction muffler 40, the discharge muffler 41 and the control valve 31 are provided. Thus the spaces between the cylinder bores 1*a* in the cylinder block 1 are utilized without waste, so that reduction in the size of the compressor C is further facilitated.

(7)

The check valves 61 and the oil separator are provided in the discharge muffler 41. This enables the compressor C to comprise the prevention function of the check valves 61 for the reverse flow of refrigerant (for the refrigerant discharged to the downstream side of the discharge muffler 41 to flow reverse to the discharge muffler 41), the prevention function of the oil separator for discharging lubrication oil to the external refrigerant circuit 50 side and the lubricating function of the oil separator for the crank chamber 5, and can reduce the size of the compressor C.

Embodiments are not restricted to those mentioned above, and the following embodiments are possible.

Between the cylinder bores 1*a* in the cylinder block 1, instead of providing the suction muffler 40 and the discharge muffler 41, the suction side check valve, which prevents the refrigerant from reversely flowing from the suction chamber 22 to the communication tube 55, and the discharge side check valve (the check valve 61), which prevents the refrigerant from reversely flowing from the communication tube 56 to the discharge chamber 21, may be provided.

Between the cylinder bores 1*a* in the cylinder block 1, instead of providing the suction muffler 40 and the discharge muffler 41, an oil separator, which separates a mist of lubrication oil, mixed with refrigerant, from the refrigerant, may be provided.

At least one of the suction side check valve or the oil separator may be provided in the suction muffler 40 provided between the cylinder bores 1*a* in the cylinder block 1.

At least one of the discharge side check valve (the check valve 61) or the oil separator may be provided in the discharge muffler 41. Otherwise, none of them may be provided therein.

The suction muffler 40 or the discharge muffler 41 may be provided between the cylinder bores 1*a* in the cylinder block 1. None of the mufflers, however, may be provided between the cylinder bores 1*a* in the cylinder block 1.

The control valve 31 may be provided between the cylinder bores 1*a* in the cylinder block 1.

The longitudinal direction of the control valve 31 may not be provided in parallel to the axial direction of the drive shaft 6.

The control valve 31 may be a type that does not have a pressure sensing member such as the bellows 35. That is, it may have such a construction that regulates the opening of the supply passage 30 by moving a valve portion, directly connected to a solenoid, by external control of a current.

The control valve 31 may not be the external control type which is controlled by an external device such as the control computer, the electric drive circuit, etc. and may be the internal control type which provides a completely independent control.

Instead of the construction in which a cam plate (the swash plate 12) integrally rotates with the drive shaft 6, the compressor C may be such type as a oscillation (wobble) type compressor in which a cam plate is supported by a drive shaft and oscillates so as to enable rotation relatively with respect to the drive shaft.

The compressor C may be a fixed displacement type in which the stroke of the pistons 20 can not be changed.

The number of cylinder bores 1*a* need not be three, but may be, for example, two or not less than four cylinders.

Both mufflers 40 and 41 may protrude outside the cylinder block 1 (the radial direction of the drive shaft 6) as far as they are arranged between the cylinder bores 1*a*.

Some of the suction muffler 40, the discharge muffler 41, the suction side check valve, the discharge side check valve (the check valve 61), the oil separator and the control valve 31 may be provided in the cylinder block 1 and their numbers are less than the numbers of the spaces between the cylinder bores 1*a*.

The plural same components of the suction mufflers 40, the discharge mufflers 41, the suction side check valves, the discharge side check valves (the check valves 61), the oil separators and the control valves 31 may be provided between the cylinder bores 1*a* in the cylinder block 1.

In order to provide at least two of the suction muffler 40, the discharge muffler 41, the suction side check valve, the discharge side check valve (the check valve 61), the oil separator and the control valve 31 in the cylinder block 1, it is not necessary to utilize all the regions between the cylinder bores 1*a*.

As described in detail above, according to the present invention, in a compressor, the size of a housing thereof can be reduced and also the configuration of the housing can be designed freely.

While the invention has been described by reference to specific embodiments chosen for the purposes of illustration, it should be apparent that numerous modifications could be made thereto by those skilled in the art without departing from the basic concept and scope of the invention.

What is claimed is:

1. A compressor; wherein a crank chamber is formed inside a housing and a drive shaft is supported so as to be able to rotate, cylinder bores are formed in a cylinder block, each piston is accommodated in each cylinder bore so as to be able to reciprocate therein, a cam plate is connected to the drive shaft so as to operate, the pistons are connected to the cam plate so as to operate, and the pistons reciprocate according to the rotation of the drive shaft so that refrigerant gas is sucked and discharged; and wherein the cylinder block, which is positioned between the front housing and the rear housing, comprises at least two of a suction space through which refrigerant gas sucked into the cylinder bores passes, a discharge space through which refrigerant gas discharged from the cylinder bores passes, a suction side check valve which is positioned upstream the suction space and also prevents refrigerant gas introduced into the suction space from reversely flowing upstream the suction space, a discharge side check valve which is positioned downstream the discharge space and also prevents refrigerant gas discharged from the discharged space to the downstream side thereof from reversely flowing into the discharge space, an oil separator which separates a mist of lubrication oil, mixed with refrigerant gas, from the refrigerant gas, and a control valve which varies the pressure in the crank chamber which accommodates the cam plate, between the cylinder bores in the cylinder block.

2. A compressor, as set forth in claim 1, wherein "N" (N is an integral number which is not less than 2) sets of the cylinder bores are provided in the cylinder block, and not less than N, of the suction space, the discharge space, the suction side check valve, the discharge side check valve, the oil separator, and the control valve are provided between the cylinder bores in the cylinder block.

3. A compressor, as set forth in claim 2, wherein at least one of the suction space, the discharge space, the suction side check valve, the discharge side check valve, the oil separator, and the control valve are provided between each cylinder bore in the cylinder block, respectively.

4. A compressor, as set forth in claim 1, wherein at least one of either the suction space or the discharge space are provided between the cylinder bores in the cylinder block.

5. A compressor, as set forth in claim 2, wherein the discharge space is provided between the cylinder bores in the cylinder block and at least one of either the discharge side check valve or the oil separator are disposed in the discharge space.

6. A compressor, as set forth in claim 1, wherein the pressure difference, through the piston, between the pressure in the crank chamber and the pressure in the cylinder bores is varied by the control valve, and then the inclination angle of the cam plate is changed according to the pressure difference, so that the compressor is allowed to be a variable displacement type which controls the discharge displacement thereof.

7. A compressor, as set forth in claim 6, wherein not less than three cylinder bores are provided in the cylinder block and the suction space, the discharge space and the control valve are provided between the cylinder bores in the cylinder block.

8. A compressor, as set forth in claim 6; wherein the control valve includes a solenoid which operates due to an electric power supply from an external control device; and wherein the control valve is located between the cylinder bores in the cylinder block.

9. A compressor, as set forth in claim 6, wherein the longitudinal direction of the control valve is approximately parallel to the axial direction of the drive shaft.

* * * * *